US005165310A

United States Patent [19]

Heinrich

[11] Patent Number: 5,165,310

[45] Date of Patent: Nov. 24, 1992

[54] TOOL FOR ROTATING INTRAVENOUS INFUSION BAG MEDICATION BOTTLE

[75] Inventor: William P. Heinrich, McHenry, Ill.

[73] Assignee: The Cloverline, Inc., Chicago, Ill.

[21] Appl. No.: 822,717

[22] Filed: Jan. 21, 1992

[51] Int. Cl.[5] ..... B25B 13/04

[52] U.S. Cl. ..... 81/120; 81/3.4

[58] Field of Search ..... 81/3.4, 53.11, 64, 120

[56] References Cited

U.S. PATENT DOCUMENTS

| | | | |
|---|---|---|---|
| 906,040 | 12/1908 | Lucas | 81/120 |
| 3,656,793 | 4/1972 | Mathews | 81/120 |
| 4,662,250 | 5/1987 | Kee | 81/3.4 X |
| 4,766,781 | 8/1988 | Grise et al. | 81/3.4 |

*Primary Examiner*—James G. Smith

*Attorney, Agent, or Firm*—Milton S. Gerstein

[57] ABSTRACT

A tool for rotating a conventional, medication bottle that is to coupled to a IV infusion bag. The tool has a main housing defining a hollow, frustro-conical shaped interior in which is mounted a flexible, high-friction, bottle-contacting member which surrounds and contacts a portion of the bottle, and a top cover/handle-member that retains the bottle-contacting member is place and also serves as a handle-element by which the tool may be rotated for screwing the bottle into the infusion bag. The top cover/handle-member may be rotated manually, or may be power-driven.

12 Claims, 2 Drawing Sheets 10
56
50
52
44
46
40
42
36
36
30
32
28
20
24

10
50
56
24
18'
18
16
14
12

60
64
62

66
68
76
74
70
78
72

50
58
52
20
28
26
24
22'
56
22
40

82
80
10
18
16

50
56

FIG 9
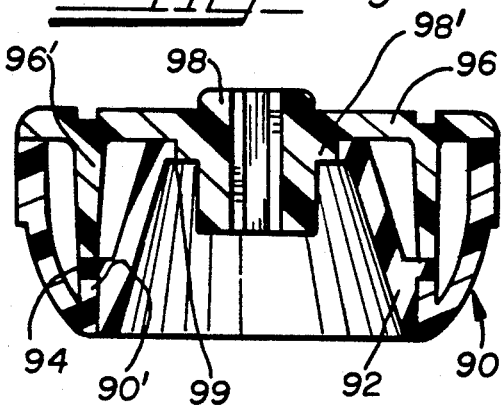
FIG 10
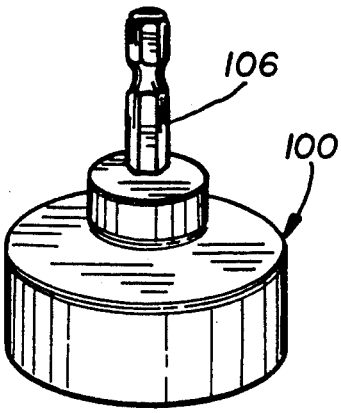
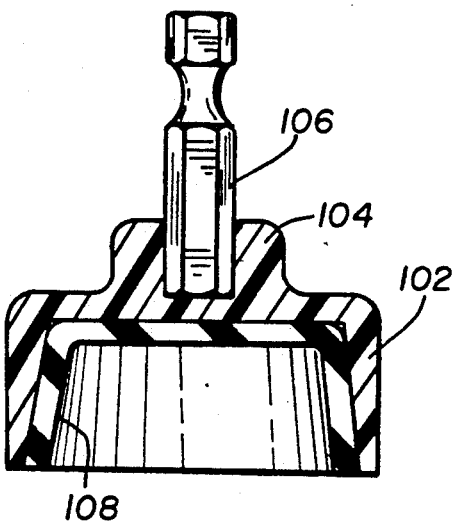
FIG 11
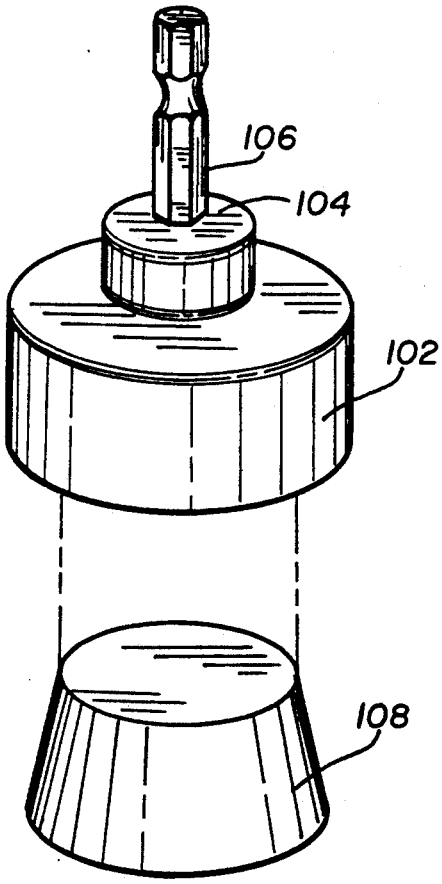
FIG 12

TOOL FOR ROTATING INTRAVENOUS INFUSION BAG MEDICATION BOTTLE

BACKGROUND OF THE INVENTION

The present invention is directed to a tool for rotating a conventional, medication bottle that is to coupled to a IV infusion bag. These medication bottles typically contain antibiotic. The mouth of the bottle, after having been opened by breaking its seal, must be screwed onto a conventional, IV, infusion bag containing sugar water, whereby the medication in the bottle drips down into the infusion bag, and mixes with the sugar water. The thus-mixed medicated water is then delivered to the patient's blood via intravenous insertion, as is well-known.

The problem with the conventional medication bottles is that it is very difficult to screw them onto the infusion bag, owing to the circular cross section of the bottles and to the smooth, outer surfaces of these bottles. At present, a nurse must rotate the bottle by hand, which is not only difficult, but also, ofttimes, painful for her, because of the high coefficient of friction between the bottle and the threaded opening of the infusion bag into which the bottle is screwed.

SUMMARY OF THE INVENTION

It is, therefore, the primary objective of the present invention to provide a tool for screwing a medication bottle from its operative couplement with an IV infusion bag, in order to make the screwing of the bottle easier and less painful.

Toward these and other ends, the tool of the invention of the invention comprises a main housing defining a hollow, frustro-conical shaped interior in which is mounted a flexible, high-friction, bottle-contacting member which actually surrounds and contacts a portion of the bottle, and a top cover/ handle-member that retains the bottle-contacting member is place and also serves as a handle-element by which the tool may be rotated for screwing the bottle into the infusion bag. The top cover/handle-member may be rotated manually, or may be power-driven.

BRIEF DESCRIPTION OF THE DRAWING

The invention will be more readily understood with reference to the accompanying drawing, wherein:

FIG. 9 is a cross-sectional, side-elevational view showing a modification of holding the rubber, gripping member in the housing;

FIG. 10 is an isometric view showing another modification of the tool of the invention which integrally incorporates a polygonally-shaped shaft for use with a power driver;

FIG. 11 is an elevational cross-sectional view thereof; and

FIG. 12 is an assembly view thereof.

DETAILED DESCRIPTION OF THE INVENTION

Figures 1, 2, 3, 4, 5, 6, 7, 8:
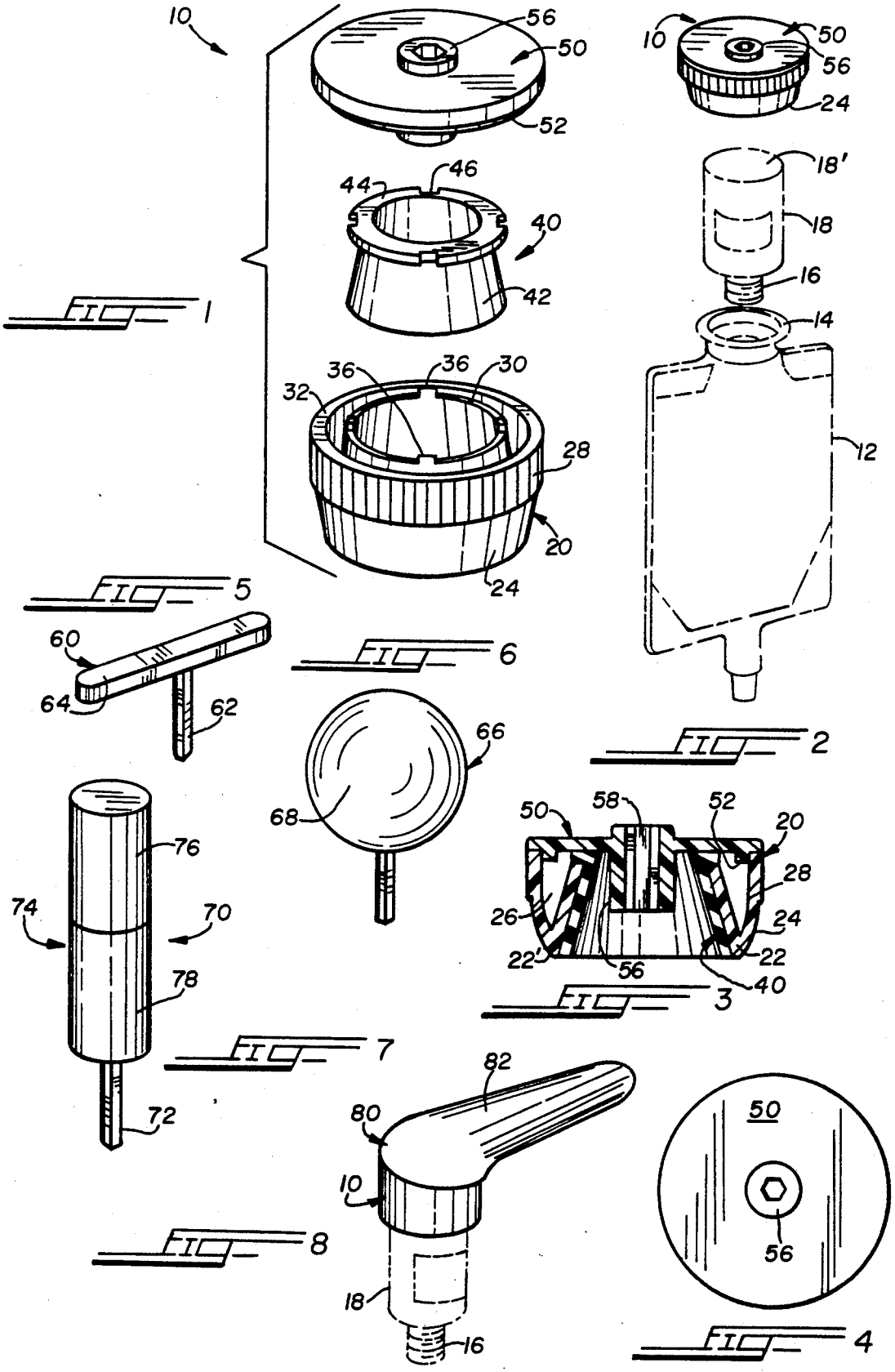
FIG. 1 is an isometric, assembly view of the tool of the invention for rotating a medication bottle into the threaded opening of an IV infusion bag.
FIG. 2 is an isometric, assembly view showing the tool of the invention in combination with a medication bottle and IV infusion bag.
FIG. 3 is a cross-sectional, side elevational view of the tool of the invention.
FIG. 4 is a top view thereof.
FIG. 5 is an isometric view showing a handle-element of the tool used for applying torque for rotating the tool, and, therefore, for rotating a medication bottle into the IV infusion bag.
FIG. 6 is an isometric view showing a different handle-element for rotating the tool of the invention.
FIG. 7 is an isometric view showing a powered handle-element for rotating the tool of the invention.
FIG. 8 is an isometric view showing yet another modification of the handle-element for rotating the tool of the invention.

Referring now to the drawing in greater detail, the tool of the invention is indicated generally by reference numeral 10. With reference for now to FIG. 2, there is shown a conventional IV infusion bag 12 having an upper, threaded opening 14 for threadingly receiving the threaded, dispensing outlet-opening 16 of a conventional medication bottle 18. The medication bottle is typically circular in cross section, and made of plastic, having a smooth outer, circumferential surface that is hard to grip, and rotate, by hand. The tool 10 of the invention is intended to grip the medication bottle 18 along a circumferential surface-portion thereof, such as adjacent the closed end 18'. After having placed the tool 10 about the portion of the bottle 18, one may then rotate the bottle 18 into the threaded opening 14 in a much easier, faster, safer manner.

The tool 10, as best seen in FIGS. 1 and 3, has a main housing 20 that in the preferred embodiment defines a hollow, frustro-conically shaped interior shell-portion 22. The main housing also has an outer shell-portion 24 integrally connected to the inner shell-portion 22 along its common, peripheral, lower edge-surface 22'. There is, thus, formed, an annular volume 26 between the inner and outer shell-portions. The approximate, upper half of the outer surface of the outer shell-portion 24 defines a knurled surface 28 which aids in the gripping thereof by a hand, for rotating the tool when attached to a medication bottle 18. The inner shell-portion 22 defines a circular, upper, edge-surface or ring 30 slightly lower in elevation as compared with circular, upper edge-surface 32 of the other-shell portion 24. Four, equally-spaced tabs, or ears, 36 project upwardly from the upper edge-surface 30, with each tab 36 terminating substantially coplanar with the upper edge-surface 32.

A flexible, rubber, intermediate, bottle-contacting member 40 is provided, which has a frustro-conical shaped main body portion 42 that fits into the frustro-conically shaped hollow interior of the inner shell-portion 22 of the main housing 20. Integrally connected to the upper edge of the frustro-conically shaped main body portion 42 is a skirt-portion 44. The skirt-portion has formed therein four, equally-spaced notches 46 that mate with the tabs 36, whereby the flexible, rubber, intermediate, bottle-contacting member 40 may be aligned, seated and retained on the upper edge-surface 30, while the frustro-conically shaped main body portion 42 is snugly received within the frustro-conically shaped hollow interior of the inner shell-portion 22, as best seen in FIG. 3. Owing the flexibility of the frustro-conically shaped main body portion 42, it may be easily folded and inserted through the upper opening of the inner shelf-portion 22 for assembling the tool 10 together.

The tool 10 is completed via a top, circular cover-member 50 having a downwardly-extending, annular, retaining ring 52, which annular ring is force-fitted into the annular volume 26, as seen in FIG. 3, for retaining the cover member in place. Such retention of the cover member compresses the skirt-portion 44 of the flexible, rubber, intermediate, bottle-contacting member 40, whereby this member is firmly retained in place.

By virtue of the fact that the hollow interior of the inner shell-portion 22 and flexible main body portion 42 are frustro-conical in shape, medication bottles 18 of different sizes may be received and gripped in the main body portion 42, the only variable being the particular, horizontal, cross-sectional slice of the main body portion 42 that actually contacts against the portion of the bottle being gripped.

The top cover-member 50 has an integral, central, hollow sleeve 56 projecting above and below, which sleeve defines a hexagonally-shaped hollow interior 58. The hollow interior 58 is used for receiving the shaft of a hex-head handle-member, such as those shown in FIGS. 5–8, and discussed below in detail. The handle-members, via their couplement to the top cover-member 50, may be used for rotating the tool 10, when greater torque is required than that which may be provided by the manual gripping of the knurled surface 28.

Referring to FIGS. 5–8, there are shown different types of handle-members for rotating the tool 10, as described above. In FIG. 5, handle-member 60 is T-shaped, having a hexagonally-shaped shaft 62 and hand-gripping portion 64. In FIG. 6, handle-member 66 has a spherical hand-gripping portion 68. In FIG. 7, power-drive handle-member 70 has a hexagonally-shaped shaft 72 is rotated by a power-drive 74. The power-drive is the same as that used in conventional, power screw-drivers, that are battery operated. A battery-compartment 76 is electrically coupled to drive motor compartment 78, as is wellknown. In FIG. 8, handle-member 80 is shown in operative engagement with the tool 10. The handle-member 80 has an elongated hand-gripping portion 82.

FIG. 9 shows a modification of the housing of the tool of the invention. In this version, the rubber bottle-gripping member 92 has a lower, integral, annular ring-member 94 instead of member 44. The housing 90 has a truncated, annular, vertical rib 90' which seats the ring member 94 thereon. The upper cover-member 96 is provided with a downwardly-projecting, tubular section 96' which defines an annular bottom surface that rests upon the top surface of the annular ring-member 84, whereby the rubber griping member is firmly held in place when the cover-member 96 is inserted into the hollow housing 90. Central tubular portion 98 has a central through-hole for reception of a drive member, as described above, and also has an annular, friction-fitting compression-ring 98' which is received in an upper, interior hole 99 formed in the upper end of the housing, whereby the parts are firmly and frictionally held together.

FIGS. 10–12 show still another modification of the tool, and is indicated generally by reference numeral 100. In this version, there is provided only a plastic or metallic housing 102 with intergal upper portion 104, in which upper portion is permanently affixed a hexagonally-shaped, steel drive-shaft 106 for mating with a conventional power driver. A rubber bottle-engaging member 108 is permanently affixed in the interior of the housing 102, by well-known techniques. The bottle-engaging member 108 may be made of rubber-like santoprene, krayton, alcryn, and the like. Of course, the bottle-engaging members of the other embodiments may also be made these materials.

While a specific embodiment of the invention has been shown and described, it is to be understood that numerous changes and modifications may be made therein without departing from the scope, spirit and intent of the invention as set forth in the appended claims.

What I claim is:

1. A tool for rotating a medication bottle for used with an IV infusion device, comprising:

a main housing having a hollow interior;

a high-friction, bottle-engaging member mounted in said hollow interior, said bottle-engaging member having a frustro-conically shaped, hollow interior;

and means for mounting said bottle-engaging member in said main housing;

said means for mounting said bottle-engaging member in said main housing comprising a top cover-member closing off said hollow interior of said main housing.

2. The tool according to claim 1, wherein said bottle-engaging member comprises a flexible, main body portion having a frustro-conical shape, and a skirt portion integral with said main boy portion, said skirt portion being sandwiched between a portion of said top cover member and a portion of said main housing.

3. The tool according to claim 2, wherein said main body portion is made of rubber, and comprises an upper rim, said skirt portion being integral with said upper rim.

4. The tool according to claim 2, wherein said bottle-engaging member comprises a central, hollow sleeve member for receiving a shaft of a handle element for drivingly rotating the tool.

5. The tool according to claim 4, wherein said hollow sleeve member comprises a hexagonally-shaped interior.

6. The tool according to claim 4, further comprising a handle-element having a main gripping portion and a shaft portion projecting from said main gripping portion; said shaft portion being insertable in said hollow sleeve member for driving rotation.

7. The tool according to claim 6, wherein the interior of said hollow sleeve member and said shaft portion are hexagonally-shaped.

8. The tool according to claim 2, wherein said main housing comprises an inner shell-portion and an outer shell-portion, said inner shell-portion having a frustro-conically shaped, hollow interior in which is received the similar frustro-conically shaped bottle-engaging member; said outer shell-portion and said inner shell-portion forming an annular region therebetween; a portion of said top cover member being received in said annular region.

9. The tool according to claim 8, wherein said portion of said top cover member comprises a downwardly-extending, annular bead member; said outer shell-portion having an upper, annular edge-surface against which said top cover-member abuts; said bead member being received in said annular region for providing a snap-fit connection between said top cover-member and said main housing.

10. The tool according to claim 9, wherein said inner shell-portion comprises an upper, annular edge-surface, said skirt-portion being sandwiched between said upper, annular edge-surface of said inner shell-portion and said top cover-member.

11. The tool according to claim 10, wherein said upper, annular edge-surface of said inner shell-portion comprises a plurality of tabs; said skirt-portion comprising a plurality a peripheral edge-surface having a plurality of notches for mating engagement with said plurality of tabs.

12. The tool according to claim 1, wherein said main housing comprising an outer surface, a portion of said outer surface being knurled for aiding in rotating the tool.

* * * * *